United States Patent [19]

Davis

[11] Patent Number: 4,713,599

[45] Date of Patent: Dec. 15, 1987

[54] PROGRAMMABLE TRIMMABLE CIRCUIT HAVING VOLTAGE LIMITING

[75] Inventor: Walter L. Davis, Coral Springs, Fla.

[73] Assignee: Motorola, Inc., Schaumburg, Ill.

[21] Appl. No.: 689,101

[22] Filed: Jan. 4, 1985

[51] Int. Cl.[4] ..... G05F 3/26

[52] U.S. Cl. ..... 323/312; 323/354

[58] Field of Search ..... 323/311, 312, 354 X; 357/51

[56] References Cited

U.S. PATENT DOCUMENTS

| | | | |
|---|---|---|---|
| 3,624,530 | 11/1971 | Zwirn | 323/354 |
| 3,930,304 | 1/1976 | Kellar et al. | 323/354 |
| 4,016,483 | 4/1977 | Rudin | 323/354 |
| 4,055,773 | 10/1977 | Schoeff | 307/296 R |
| 4,225,878 | 9/1980 | Dobkin | 357/45 |
| 4,238,724 | 12/1980 | Klaus et al. | 323/354 |
| 4,412,241 | 10/1983 | Nelson | 323/354 |
| 4,434,358 | 2/1984 | Apfelbeck et al. | 323/235 |
| 4,608,530 | 8/1986 | Bacrania | 323/315 |

*Primary Examiner*—Patrick R. Salce
*Assistant Examiner*—Jeffrey Sterrett
*Attorney, Agent, or Firm*—Daniel K. Nichols; Joseph T. Downey; Mark P. Kahler

[57] ABSTRACT

A trimmable circuit includes a first transistor for generating an output current and a plurality of programmable trimming networks connected to the first transistor for regulating the output current of the first transistor. The plurality of programmable trimming networks include a network for decreasing the output current of the first transistor by introducing a second transistor into the trimmable circuit to draw current away from the first transistor and a network for increasing the output current of the first transistor. The trimmable circuit further includes a voltage-divider circuit connected to the plurality of programmable trimming networks, for limiting the voltage across any trimming network during programming.

5 Claims, 5 Drawing Figures

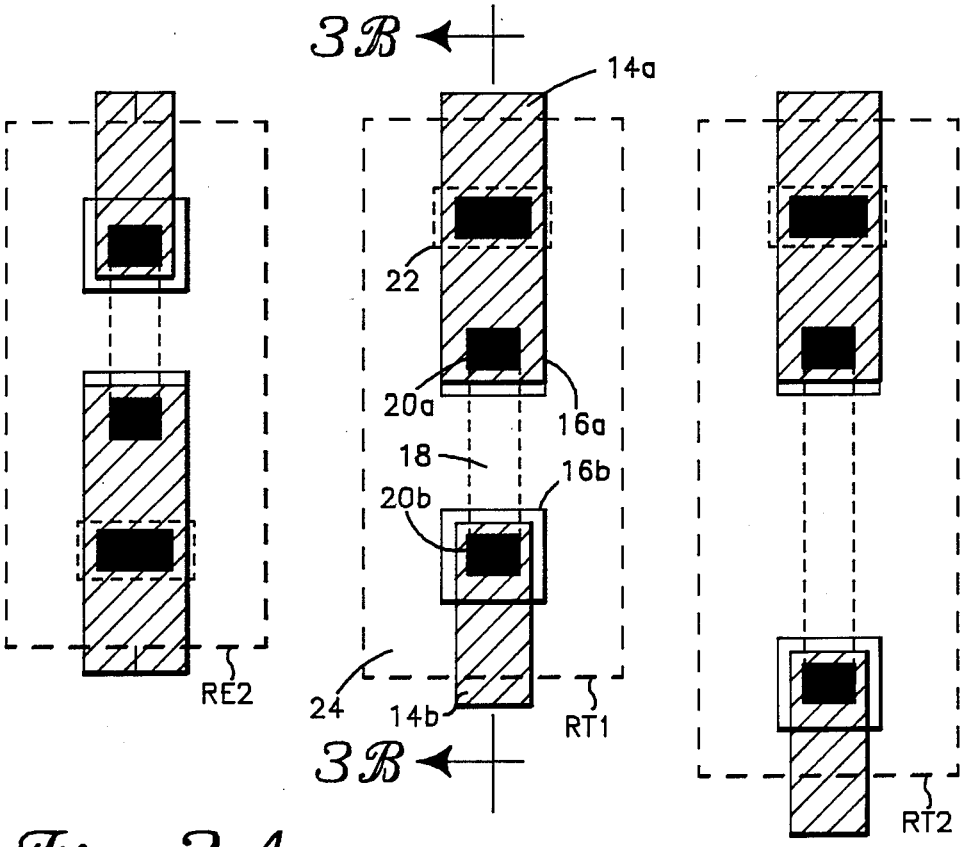
Fig. 3A
Fig. 3B
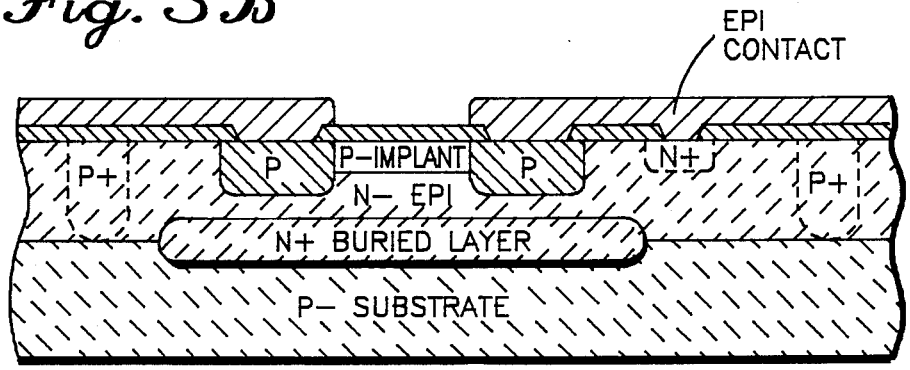

PROGRAMMABLE TRIMMABLE CIRCUIT HAVING VOLTAGE LIMITING

BACKGROUND OF THE INVENTION

This invention relates to trimmable circuits and more particularly to an integrated circuit which is trimmed by electrical programming signals that are used to modify the values of selected components of the integrated circuit by shorting zener diode fuse structures.

Zener diodes are widely used in the integrated circuit art as programmable fuses that can be "blown" or converted from an essentially open circuit condition to an essentially short circuit condition by the application of a high current pulse to the zener fuse structure. One particularly important application involves using zener fuses as programmable elements that are used to modify the values of circuit components so that the performance parameters of a circuit function can be adjusted to fall within precise limits. In this application, the shorting mechanism of the zener fuse is used to modify the operation of a circuit by either shorting out a component such as a resistor, capacitor or transistor, or by completing the connection of one or more partially connected components.

To date, the use of zener trimming techniques has been limited to either high voltage circuits, or to circuits that have been electrically and physically designed to withstand the very high supply voltages of 10 to 25 volts that have been needed to program zener diode fuses. Further, most of the trim networks that have been designed to effect component value changes via the programming of zener fuses will not operate over the low supply voltages range of 1.0 to 1.5 volts that is of importance in many battery operated applications including radio paging receivers.

The restrictions imposed by the present zener trimming techniques thus mean that the techniques either cannot be directly applied to low voltage circuits, or that they negatively impact the cost of these circuits. The higher cost factor is a direct consequence of the present need for zener trimmed circuits to withstand the high supply voltage associated with the trimming procedure. Since low voltage circuits are normally designed with closer physical layout spacings than high voltage circuits, the use of high voltage layout spacings results in larger integrated circuit chip sizes and higher costs.

SUMMARY OF THE INVENTION

It is therefore an object of the present invention to provide a programmable circuit in which the electrical parameters thereof are adjustable with signals having voltage levels which would normally damage the programmable circuit, without damaging the programmable circuit.

It is another object of the present invention to provide a programmable circuit in which the output current thereof can be either increased or decreased.

It is yet another object of the present invention to provide a method of adjusting the electrical parameters of a programmable circuit with signals having voltage levels which would normally damage the programmable circuit, without damaging the programmable circuit.

It is still another object of the present invention to provide a programmable circuit in which the electrical parameters thereof are adjustable utilizing zener diode fuse elements.

It is still yet another object of the present invention to provide a programmable low voltage circuit in which the electrical parameters thereof are adjustable by the application of signals, having voltage levels which would normally damage the low voltage circuit, to zener diode fuse elements without damaging the programmable circuit, and thus allowing present low voltage circuit design and layout techniques to be utilized.

It is a further object of the present invention to provide a programmable circuit in which the electrical parameters thereof can be adjusted at the wafer test level and the packaged part testing level of the integrated circuit fabrication process.

These and other objects which will become apparent are provided in accordance with the invention wherein a programmable current source circuit comprises a plurality of trimming networks connected thereto for adjusting the electrical parameters thereof. Each of the trimming networks includes means for actively introducing the trimming network into the first circuit. In the preferred embodiment at least one trimming network may be utilized to increase the output of the current source circuit while at least one of the other trimming networks may be utilized to decrease the output of the current source circuit. The preferred means for actively introducing each trimming network into the circuit is a zener diode fuse which is shorted by applying a signal having a voltage level which would normally damage the functional circuitry connected thereto and portions of the trimmable circuit itself. The signal is applied to the zener diode in such a fashion as to prevent damage to the circuit.

BRIEF DESCRIPTION OF THE DRAWINGS

FIGS. 3A and 3B are diagrams illustrating the physical layout of the resistors in the programmable circuit of FIG. 1 as they appear in an integrated circuit.

DETAILED DESCRIPTION OF THE PREFERRED EMBODIMENT

Figure 1:
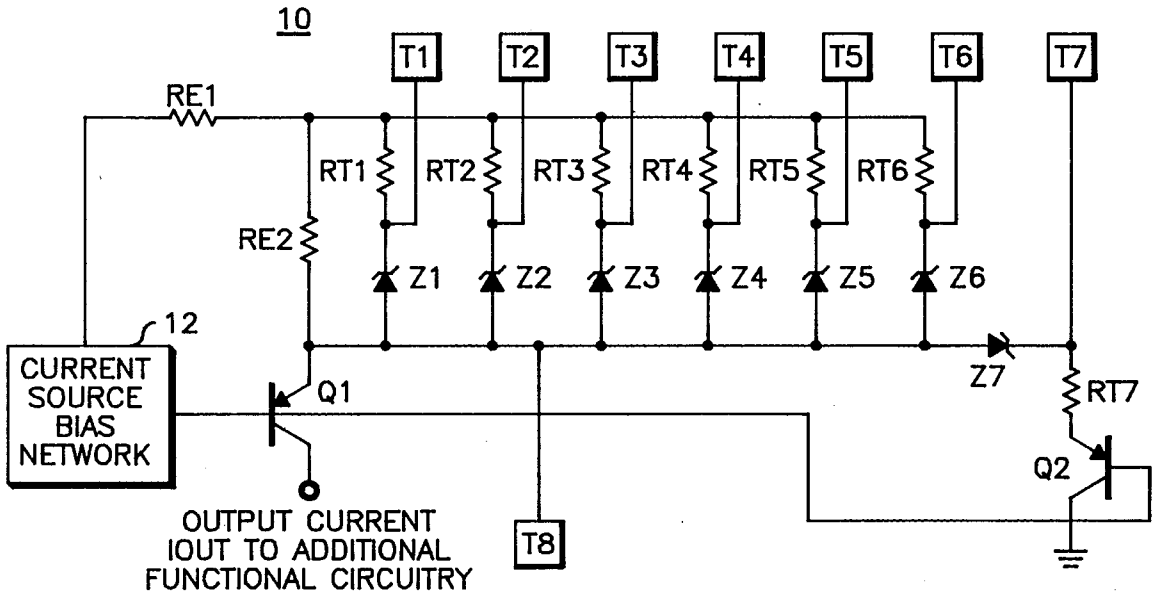
FIG. 1 is a schematic diagram of the programmable circuit of the present invention.

Referring now to the drawings, wherein like reference numerals designate identical or corresponding parts throughout the several views, and more particularly to FIG. 1 thereof, a programmable current source circuit 10 is illustrated. It should be understood that for the purposes of describing this invention low voltage is intended to mean any voltage at which the circuit will operate without damage and high voltage is intended to mean any voltage level which will cause damage to the circuit. The programmable current source circuit 10 is comprised of the resistor RE1 having one end connected to the current source bias circuit 12 and the other end connected to the resistor RE2 and one end of each of the resistors RT1–RT6, the transistor Q1 which has a collector connected to the output of the current source circuit, its base connected to the output of a current source bias circuit 12 and its emitter connected to the emitter resistor RE2, and a plurality of trimming networks which will be described in more detail hereinafter.

The first trimming network is comprised of the trimming resistor RT1 in series with the zener diode Z1 which has one end connected to the emitter of the transistor Q1. The junction between the resistor RT1 and the other end of the zener diode Z1 is also connected to the programming pad T1. The second trimming network is comprised of the transistor RT2 and zener diode Z2 which also has one end connected to the emitter of the transistor Q1. The junction between the resistor RT2 and the other end of the zener diode Z2 is connected to the programming pad T2. The third trimming network is comprised of the resistor RT3 in series with the zener diode Z3 which also has one end connected to the emitter of the transistor Q1. The junction between the resistor RT3 and the other end of the zener diode Z3 is connected to the programming pad T3. The fourth trimming network is comprised of the resistor RT4 in series with the zener diode Z4 which also has one end connected to the emitter of the transistor Q1. The junction between the resistor RT4 and the other end of the zener diode Z4 is connected to the programming pad T4. The fifth trimming network is comprised of the resistor RT5 in series with the zener diode Z5 which also has one end connected to the emitter of the transistor Q1. The junction between the resistor RT5 and the other end of the zener diode Z5 is connected to the programming pad T5. The sixth trimming network is comprised of the resistor RT6 in series with the zener diode Z6 which also has one end connected to the emitter of the transistor Q6. The junction between the resistor RT6 and the other end of the zener diode Z6 is connected to the programming pad T6. The seventh trimming network is comprised of the transistor Q2 which has its emitter connected to the series combination of resistor RT7 and the one end of the zener diode Z7. The junction between the resistor RT7 and one end of the zener diode Z7 is connected to programming pad T7, while the other end of the zener diode Z7 is also connected to the emitter of the transistor Q2. The base of the transistor Q2 is connected to the output of the current source bias circuit 12 while the collector of the transistor Q2 is connected to ground. All the ends of the zener diodes Z1 through Z6 that are connected to the emitter of the transistor Q1 are also connected to the pad T8.

The current source bias network 12 used in the preferred embodiment is a conventional bandgap type reference in which the component values have been selected to set a reference bias level of 5 microamperes for a PNP transistor (not shown) connected directly across its output bias terminals.

In the preferred embodiment, resistor RE1 has a value of 1.0 kilo-ohm, RE2 has a value of 6.2 kiloohms, RT1 has a value of 7.2 kilo-ohms, RT2 has a value of 14.4 kilo-ohms, RT3 has a value of 28.8 kilo-ohms, RT4 has a value of 57.6 kilo-ohms, RT5 has a value of 115 kilo-ohms, RT6 has a value of 230 kilo-ohms and RT7 has a value of 2 kilo-ohms. These values provide a nominal (untrimmed) output current of 2.50 micro-amperes, and the output can be varied by plus or minus 35% by programming the appropriate zener fuse elements.

The programmable current source circuit 10 is initially programmed by applying high current programming pulses to the zener fuse elements Z1 through Z7. Passing the appropriate current through the zeners causes them to be shorted out by a very low resistance conductive path that forms across the diode junction. The conductive path is formed by Aluminum metal atoms that are carried across the diode junction by the well known avalanche induced migration transport mechanism. That is, the high programming current pulse carries Aluminum atoms from the device terminals across the semiconductor junctions, generating a short circuit. Thus, by programming zener fuses Z1 through Z6, resistors RT1 through RT6 can be connected into the circuit across emitter resistor RE2, which increases the output current from transistor Q1. Similarly, the output current of Q1 can be decreased by programming zener fuse Z7 via pad T7, which connects transistor Q2 into the circuit and forms a shunt path that diverts to ground some of the current that would otherwise flow from RE2 into transistor Q1.

The values of resistors RT1 through RT6 have been selected to be increasing multiples of 2 times the smallest resistor RT1. This insures that the equivalent resistance of the network formed by RE2 plus all of the programmed trim resistors can be trimmed over a wide range with a minimum resolution of 1.6%. These trim resistor values, plus the logrithmic relation between the value of the output current and the equivalent emitter resistance between the emitter of Q1 and the B+ supply, as determined by the well known diode equation for semiconductor diodes, allow the output current to be trimmed or adjusted over a wide range with a resolution of better than 1%.

Thus, by programming combinations of zener fuses Z1 through Z7, the value of the output current of transistor Q1 can be trimmed over a wide range with a resolution or step size of less than 1%.

In practice, the untrimmed output current of the programmable circuit 10 can be measured at the wafer probe or package testing levels of the integrated circuit fabrication process, and the measured value of the output current used to determine which fuses should be programmed to set the output current at the desired value. The appropriate zener diode fuses are then programmed, and the current is remeasured to insure that it falls within the allowable test limits. The manner in which the zener diode fuses should be programmed is determined from the value of the untrimmed measured current, and simply involves calculating the resistance change needed to achieve the required change in output current. This procedure will be well understood by persons skilled in the I.C. design art and the details are not presented herein.

Figure 4:
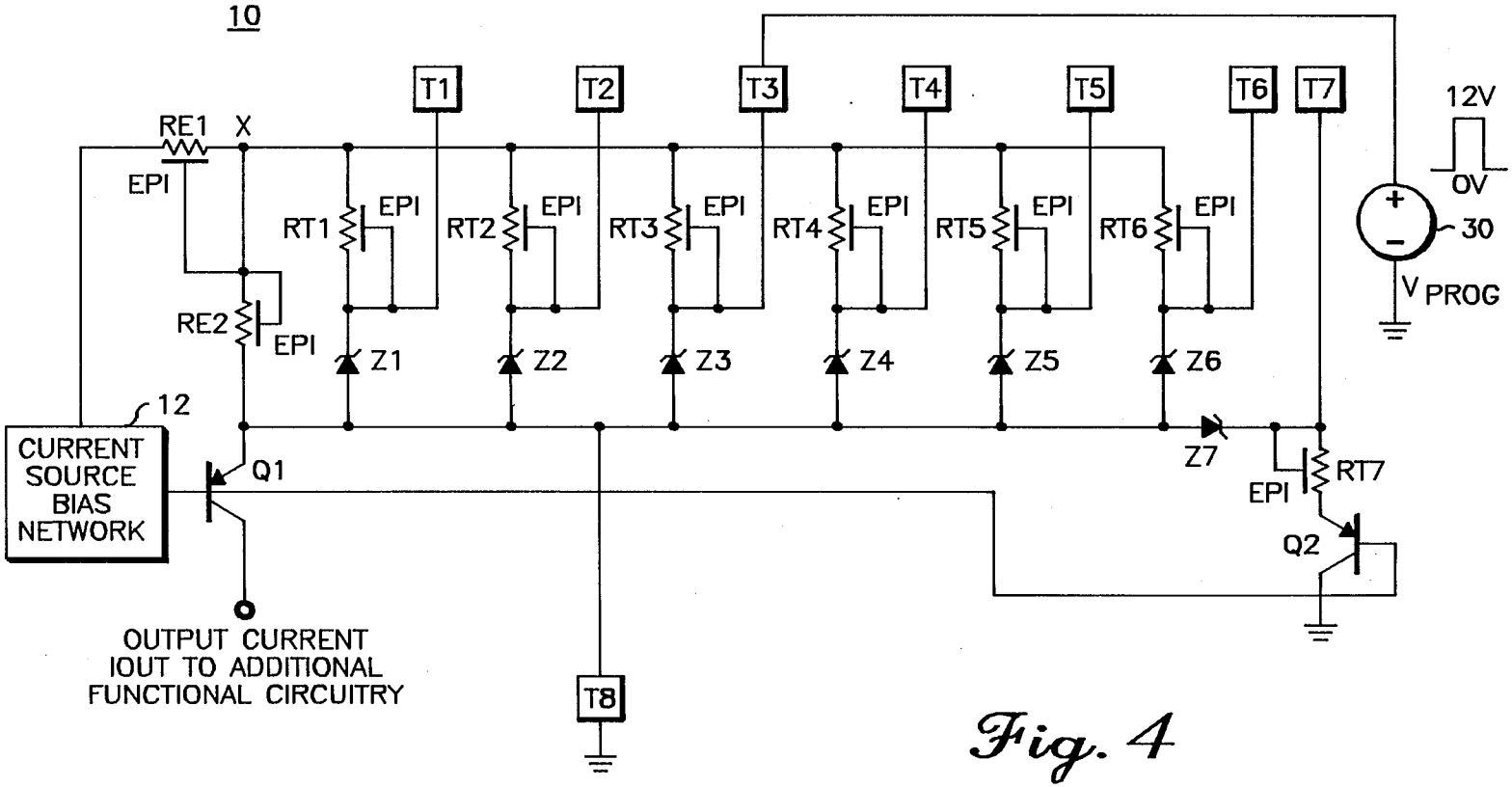
FIG. 4 is a schematic diagram of the programmable circuit of FIG. 2 further illustrating the programming circuitry.

The circuit configuration shown in FIG. 1 will operate properly at supply voltages ranging down to less than 1.0 volts, satisfying one of the objects of the present invention. However, the schematic diagram shown in FIG. 1 does not indicate how the primary objective of isolating a low voltage functional circuit from the high voltages required to program the zener fuses is obtained. The manner in which this latter objective is met is shown in FIGS. 2, 3 and 4.

Figure 2:
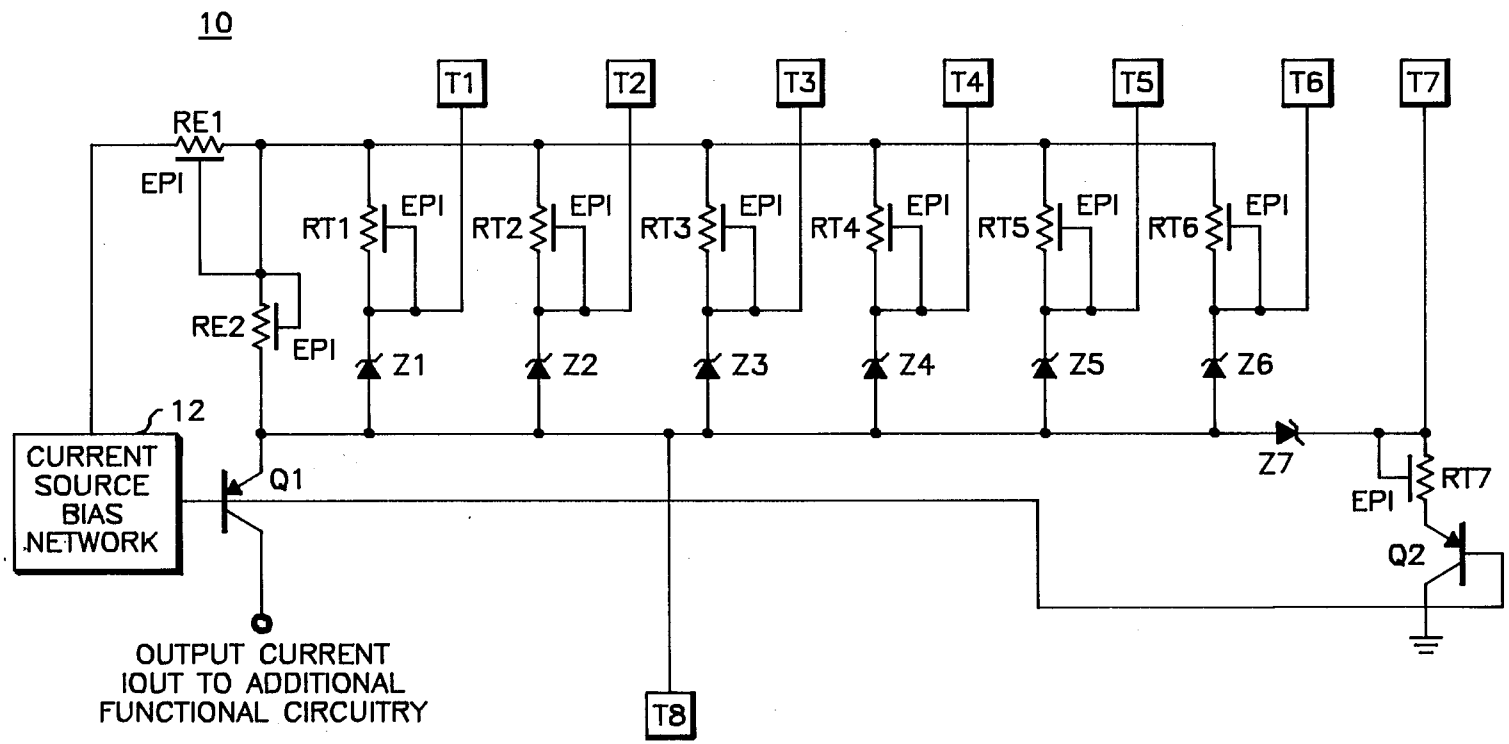
FIG. 2 is a schematic diagram of the programmable circuit of FIG. 1 further illustrating how the resistors in the programmable circuit are formed and biased to limit the voltage that is applied to the functional circuit portion when the zener diodes are programmed.

FIG. 2 is a detailed schematic diagram of the programmable circuit 10 of FIG. 1 further illustrating how the resistors in the trimming networks are connected and biased to provide the isolation between the high programming voltage applied to the zener diode fuses and the low voltage functional circuitry containing the trimming networks.

As a general rule, the resistors on a bipolar integrated circuit are formed in junction isolated regions of epitaxial silicon material, and the epitaxial regions are connected to the B+ power supply voltage to reverse bias the parasitic diodes that are inherent in the structure and thus insure that the device acts like a resistor. In the common case in which an N doped epitaxial layer is used, the N tubs in which the resistors are formed are normally connected to the B+ supply terminal or the most positive supply voltage that is applied to any portion of the circuitry connected to the resistor.

If this normal method of resistor tub biasing were used for the circuit shown in FIG. 1, all of the resistors would be placed in one or more isolated epitaxial regions or tubs in which the N doped epitaxial material would be connected to the B+ terminal of the circuit. However, the use of this tub biasing technique would require that, during programming, the voltage on the B+ circuit terminal be raised to the highest voltage applied to a respective trimming network. Otherwise, the parasitic diodes between the epitaxial layer and the resistors could be biased into conduction, disrupting the trimming process. Thus, considering that approximately ten to twelve volts must be applied to the zener diode fuses to program them properly, the conventional method of biasing the resistors would require that ten to twelve volts be applied to the trimming network circuit being trimmed.

Since the circuits of interest here normally operate at low voltages—typically 1.0 to 1.5 volts, the application of ten to twelve volts to the circuit elements is highly undesirable. First the physical layouts of low voltage circuits normally use smaller layout spacings than high voltage circuits to reduce die size and cost, and to improve circuit performance via reduced parasitic capacitances.

In addition, low voltage circuits frequently use circuit components such as junction capacitors that would be physically damaged or destroyed by the application of ten volts to the B+ supply line.

To avoid these problems by substantially reducing the voltage stress that is applied to the B+ supply line during programming, the resistor in each of the trimming networks of FIG. 2 is placed in an individual epitaxial region or tub. Each of the tubs is biased as shown in FIGS. 3A and 3B which will be explained in more detail immediately hereinafter.

Referring now to FIGS. 3A and 3B a portion of the semiconductor implementation of the circuit 10 is illustrated. FIG. 3A is a partial top view of the circuit 10 of FIG. 2 illustrating the layout of the resistors RE2, RT1 and RT2. FIG. 3B is a cross sectional view of the resistor RT2 of FIG. 3A illustrating the layer structure of a bipolar integrated circuit containing the trimming network. The portion of the circuit 10 comprising the resistor RT1 includes the metallization layers 14*a* and 14*b*, the P type regions 16*a* and 16*b*, the P- body of the resistor 18, the contacts 20*a* and 20*b* to the resistor 18, the EPI contact 22 and the EPI tub 24. It should be understood that the other resistors are of similar construction and therefore a detailed explanation of each resistor is unnecessary. As stated previously, each resistor is in a separate isolated epitaxial region or EPI tub that is isolated from the other elements of the circuit by a P type isolation diffusion. The resistors are formed by an ion implanted layer that has a resistivity of 2 Kilo-ohms per square. Contact to the resistors is made with ohmic contacts that connect the circuit metallization to P type regions that are electrically connected to the ion implanted body regions of the resistors. Contact to the epitaxial regions is made by an ohmic contact that connects the circuit metallization to an N+ region that is in electrical contact with the N doped epitaxial layer.

All of the electrical connections are identical to those shown in FIG. 2 with the following additions. The epitaxial region surrounding resistor RE1 is connected to the terminal connecting RE1 to resistors RE2 and RT1 through RT6. The epitaxial region surrounding resistor RE2 is also connected to the terminal that is connecting RE2 to resistor RE1 and resistors RT1 through RT6. The epitaxial region containing resistor RT1 is connected to the junction between RT1 and zener Z1, which is also connected to trim pad T1. The epitaxial region containing resistor RT2 is connected to the junction between RT2 and zener Z2, which is also connected to trim pad T2. The epitaxial region containing resistor RT3 is connected to the junction between RT3 and zener Z3, which is also connected to trim pad T3. The epitaxial region containing resistor T4 is connected to the junction between RT4 and zener Z4, which is also connected to trim pad T4. The epitaxial region containing resistor RT5 is connected to the junction between RT5 and zener Z5, which is also connected to trim pad T5. The epitaxial region containing resistor RT6 is connected to the junction between RT6 and zener Z6, which is also connected to trim pad T6. The epitaxial region containing resistor RT7 is connected to the junction between RT7 and zener Z7, which is also connected to trim pad T7.

In the following paragraphs, it will be shown how one method of biasing the resistor tubs in the trim network significantly reduces the voltage stress placed on the functional circuitry which is connected to the trimmable circuit, during the trim process.

Referring now to FIG. 4 a method of programming the zener fuses Z1–Z7 in the trim circuit 10 is illustrated. It should be noted that the circuit elements of the trim network are identical to those shown in FIGS. 1, 2 and 3, with like numbers referring to identical elements. In addition, the trim pad designated as T8 is connected to an electrical ground potential. The positive terminal of a source of programming pulses 30 has been connected to trim pad T3, and the negative terminal of the source of programming pulses 30 is connected to ground potential.

The programming pulse source 30 generates a 12 volt programming pulse and is current limited to provide an output current of not more than 300 milliamperes. Further, the pulse duration is approximately 100 microseconds, and the output pulse can be regenerated as many times as is required to program the fuse. In practice, the programming source is implemented with a programmable test machine, such as the LTX model 80, manufactured by LTX Corp. that is also used to test the integrated circuit at the wafer level.

Before the pulse is applied, zero volts is applied to the circuit, and there is thus no voltage stress on the functional circuitry. When the programming pulse is being applied, a maximum of twelve volts is applied to pad T3 and to the end of the resistor RT3 which is connected to pad T3. Under these conditions, the resistors RE2 and RT3 form a voltage divider, and only 2.2 volts appears at the junction of RE2 and RT3. Thus, no more than 2.2 volts can be applied to any point in the functional circuitry when resistor RT3 is programmed.

Further, it should be noted that when fuse Z3 is programmed, the EPI tub containing resistor RT3 is properly biased by connecting it to the most positive voltage applied to the resistor, and that the EPI tubs for resistor RE1 and RE2 are also properly biased. Otherwise, the functional circuitry could be damaged during programming because destructively high currents could flow through the parasitic junctions in the resistor tubs.

The other zener diode fuses in the circuit are programmed in a similar manner. The structure of resistors RT1 through RT7 will also be properly biased when fuses Z1 through Z7 are programmed. In addition, it can be seen that the voltage that is impressed on node X during programming is considerably less than the programming voltage, with the voltage at X taking its largest value when zener fuse Z1 is programmed.

Then the programming voltage is attenuated by the voltage divider formed by resistors RE2 and RT1 and the maximum voltage appearing at X is 0.46 $V_{PROG}$, or 5.5 volts for a 12 volt programming pulse. In has been practically demonstrated that this transient 5.5 volt level does not damage the most sensitive circuit elements used in the functional circuitry that is normally operated at 1.5 volts.

Thus, the trimmable current source greatly reduces the voltage stress that is applied to the functional circuit that is being trimmed, and allows low voltage design techniques to be used in conjunction with high voltage zener trim techniques.

Obviously, numerous (additional) modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A trimmable circuit, comprising:

a first transistor, for generating an output current;

a plurality of programmable trimming networks, connected to the emitter of said first transistor, for regulating the output current of said first transistor;

said plurality of programmable trimming networks including a programmable trimming network for decreasing the output current of said first transistor and a programamble trimming network for increasing the output current of said first transistor, said trimming network for decreasing the output current of said first transistor including a second transistor; and a voltage-divider circuit, connected to said plurality of programmable trimming networks, for limiting the voltage across any trimming network during programming.

2. The circuit, according to claim 1, wherein said programmable trimming network for increasing the output current of said first transistor includes a series connected zener diode and resistor.

3. The circuit, according to claim 2, wherein said programmable trimming network for increasing the output current of said first transistor further includes a programming pad connected between the junction of the zener diode and resistor thereof.

4. The circuit, according to claim 1, wherein said programmable trimming network for decreasing the output current of said first transistor further includes a series connected zener diode and resistor combination having one end connected to the emitter of said first transistor and the other end connected to the emitter of said second transistor.

5. The circuit, according to claim 4, wherein said programmable trimming network for decreasing the output current of said first transistor further includes a programming pad connected between the junction of the zener diode and resistor thereof.

* * * * *